United States Patent [19]

Brinkman

[11] 4,227,499

[45] * Oct. 14, 1980

[54] DEVICE FOR SUPPLYING FUEL TO A COMBUSTION ENGINE

[75] Inventor: Willem Brinkman, Velp, Netherlands

[73] Assignee: Holec N.V., Hengelo, Netherlands

[ * ] Notice: The portion of the term of this patent subsequent to Mar. 16, 1993, has been disclaimed.

[21] Appl. No.: 942,775

[22] Filed: Sep. 15, 1978

Related U.S. Application Data

[62] Division of Ser. No. 665,533, Mar. 10, 1976, Pat. No. 4,120,617.

[30] Foreign Application Priority Data

Jan. 21, 1976 [NL] Netherlands ..... 7000624

[51] Int. Cl.[3] ..... F02M 51/00; F04B 17/04; F04B 35/04

[52] U.S. Cl. ..... 123/499; 123/382; 417/418; 417/415

[58] Field of Search .... 123/139 E, 139 AE, 139 AD, 123/139 AR, 32 AE; 417/410, 415, 418, 534; 310/29, 21, 36, 38; 92/13, 13.1, 13.5, 13.7

[56] References Cited

U.S. PATENT DOCUMENTS

| | | | |
|---|---|---|---|
| 2,272,855 | 2/1942 | Sullivan | 310/21 |
| 3,784,334 | 1/1974 | Hilgert | 417/415 |
| 3,943,892 | 3/1976 | Brinkman | 123/139 E |

FOREIGN PATENT DOCUMENTS

| | | | |
|---|---|---|---|
| 765791 | 1/1957 | United Kingdom | 417/418 |

*Primary Examiner*—P. S. Lall
*Attorney, Agent, or Firm*—John P. Snyder

[57] ABSTRACT

Device for supplying fuel to the atomizer of a combustion engine comprises at least a pump to be connected with the atomizer having a piston-bounded pump chamber and an electromagnet for reciprocating said piston.

Said device is improved, particularly with regard to the seal of the pump piston, the control and the adjustment of the pumped quantity of fuel, the life-time and the cooling of the device, the compactness and simplicity of construction and/or simplification of maintenance.

9 Claims, 11 Drawing Figures

Figures 4, 5, 6:
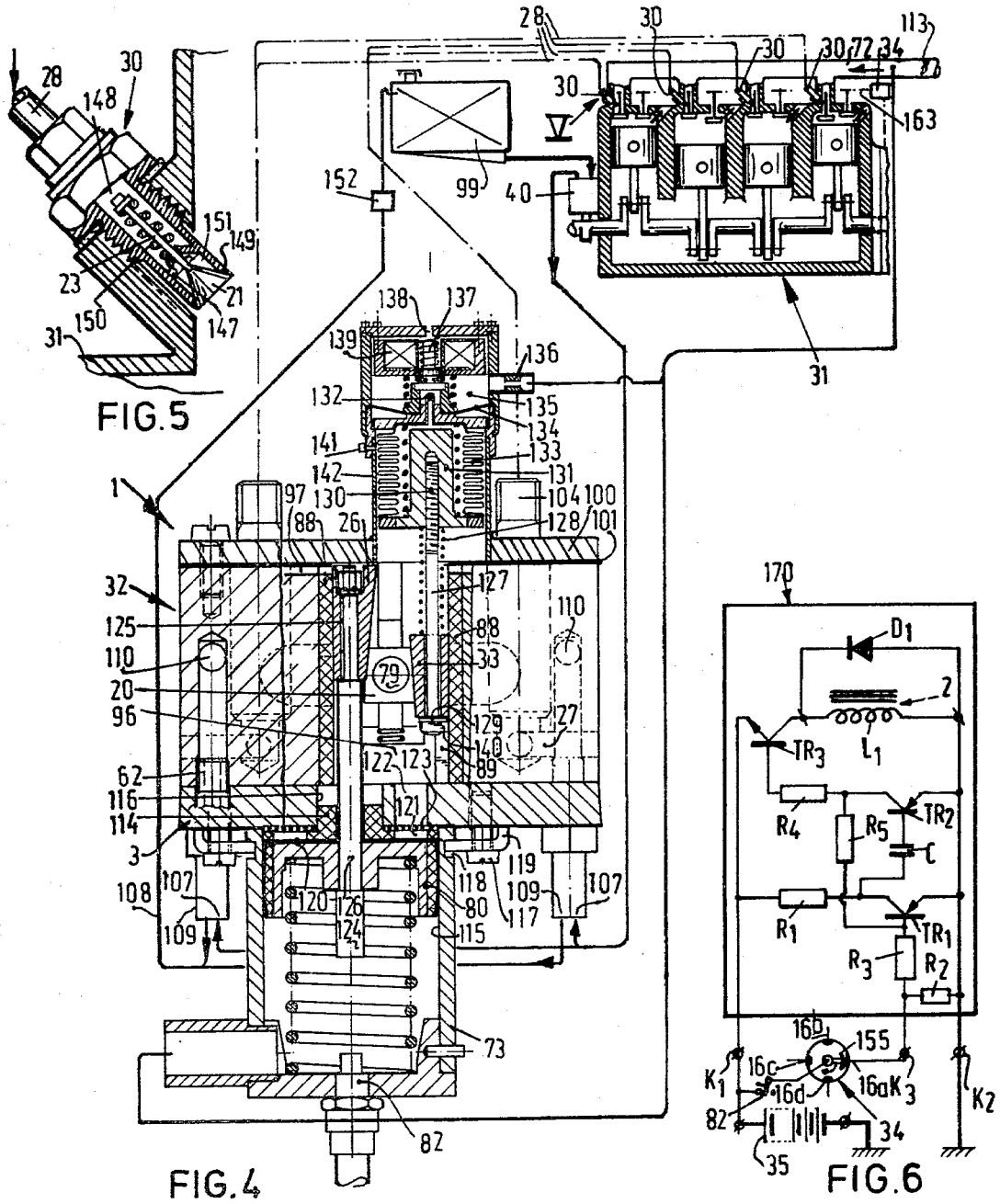

FIG.1
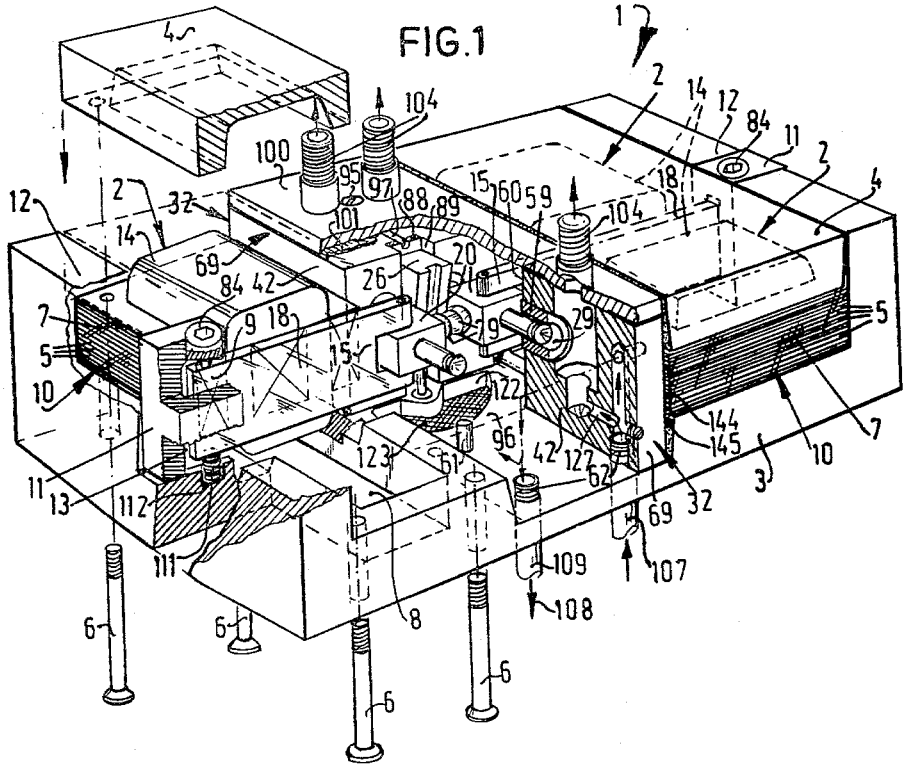
FIG.8
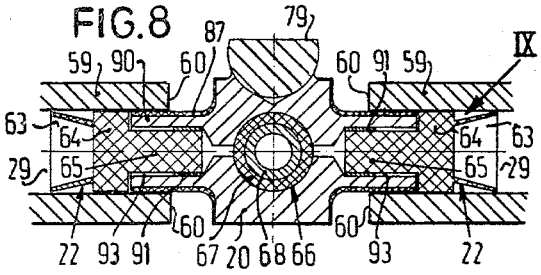
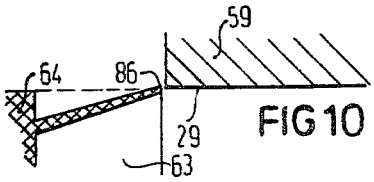
FIG 10
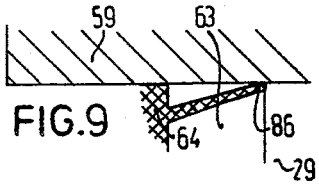
FIG.9

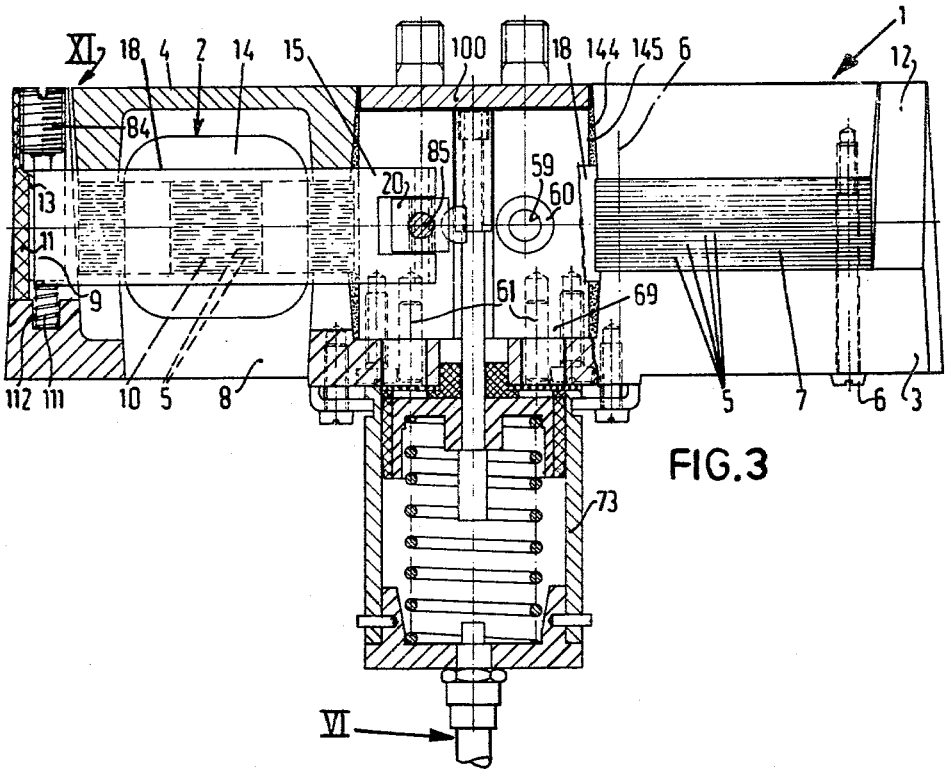
FIG.3
FIG.2
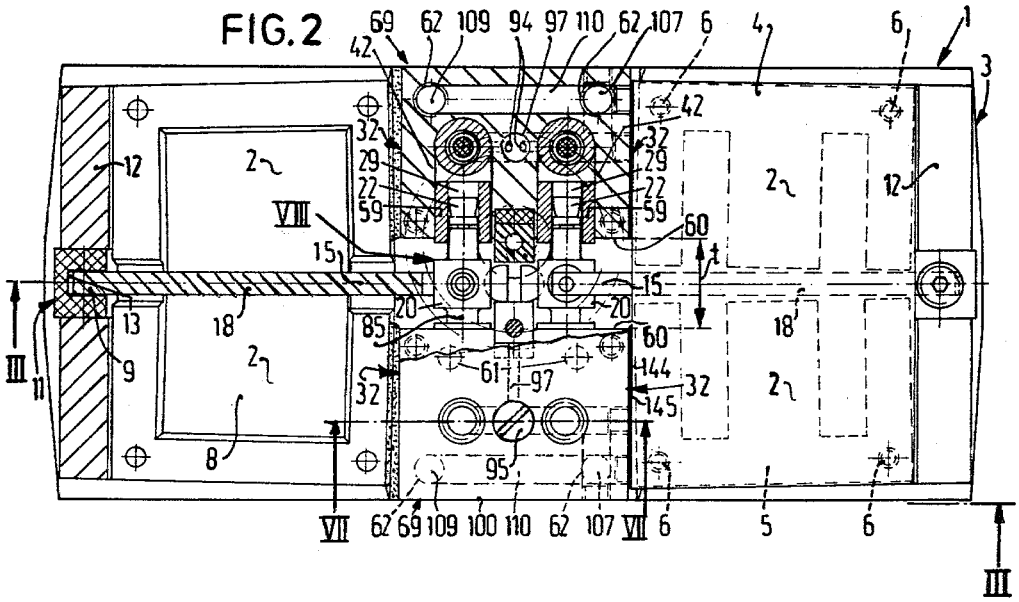

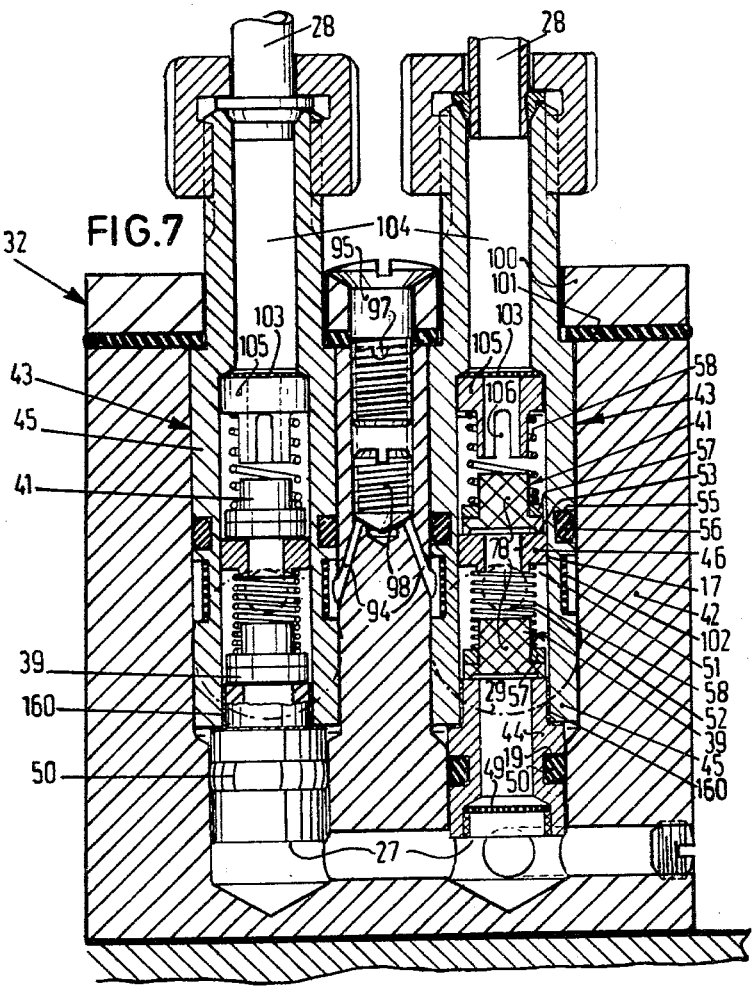
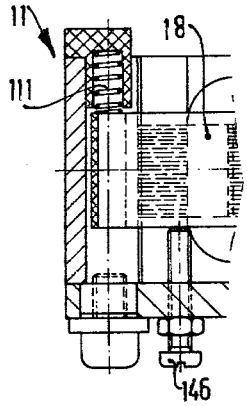
FIG.11

DEVICE FOR SUPPLYING FUEL TO A COMBUSTION ENGINE

This is a division of application Ser. No. 665,533 filed Mar. 10, 1976, now U.S. Pat. No. 4,120,617.

The invention relates to a device for supplying fuel to the atomizer of a combustion engine comprising at least one pump to be connected with the atomizer having a piston-bounded pump chamber and driving means for reciprocating said piston. Such a device is disclosed in Dutch Patent Application No. 73.15769 and U.S. patent application Ser. No. 560,771.

The invention has for its object to provide a further improvement of the prior device, particularly with regard to the seal of the pump piston, the control and the adjustment of the pumped quantity of fuel, the lifetime and the cooling of the device, the compactness and simplicity of construction and/or simplification of maintenance.

The many steps to be taken in accordance with the invention, preferably applied in conjunction, are disclosed in the Claims and will be explained in the following description with reference to a drawing. In the drawing:

FIG. 1 is a perspective elevation, partly broken away, of a preferred embodiment of a device in accordance with the invention, FIG. 2 is a plan view, partly broken away, of the device of FIG. 1, FIG. 3 is a sectional view taken on the line III—III in FIG. 2, FIG. 4 is a sectional view taken on the line IV—IV in FIG. 3, showing schematically the connection with a combustion engine, FIG. 5 is an enlarged sectional view of a detail V in FIG. 4, FIG. 6 shows an electrical circuit diagram for use in the device of FIG. 1, FIG. 7 is an enlarged sectional view taken on the line VII—VII in FIG. 2, FIG. 8 is an enlarged, longitudinal sectional view of a detail VIII in FIG. 2, FIG. 9 shows on an enlarged scale a detail IX of FIG. 8, FIG. 10 is a sectional view corresponding to FIG. 9 in the dismounted state and FIG. 11 shows a variant of detail XI in FIG. 1.

The device 1 comprises a cast or spray-cast aluminum frame 3. Magnet plates 5 are stacked up in a jig and interconnected at their outer edged by glue 7. Two pairs of electro-magnets 2 are firmly secured by means of bolts 6 between the frame 3 and a lid 4. Each of the electro-magnets 2 comprises a core 10 formed by a packet of magnet plates 5 and an energizing coil 14 surrounding said core 10. Beneath each electro-magnet 2 the frame 3 has a wide air passage 8 allowing air to pass for cooling the electro-magnets 2. A plate-shaped armature 18 is adapted to reciprocate between each pair of alternately energized magnets 2. Each armature 18 is pivoted by an end 9 in a slot 13 of a bearing element 11 of synthetic resin, preferably Arnite, embedded in a bearing block 12, which is integral with the frame 3.

At the free end 15 each armature 18 holds a cross-shaped coupling member 20, with which are connected two displacer bodies 22 of two fuel pumps 32. The stroke of the displacer bodies 22 is determined by adjustable actuating means arranged on either side of the coupling members 20 and formed by two wedges 26 and 33. Each pump 32 comprises a pump chamber 29 accommodated in a pump housing 42 and having a fuel inlet 27 and a fuel outlet 28, each of them leading to an atomizer 30 of a combustion engine 31. The inlet valve 39 and the outlet valve 41 are arranged in a separate valve housing 43, to be arranged in the housing 42, said valve housing comprising three parts to be interconnected i.e. an inlet seat 44, a tube 45 secured to the former by cement 160 and an outlet seat 46 secured in place in said tube 45 by cement 17. The inlet seat 44 to be connected with a fuel supply pump 40 has at the beginning a filter 49 of filter gauze and an annular groove 19 receiving a seal 50 for isolation from the pump housing 42. The tube 45 has an external annular groove 51 and a channel 52, through which the space 53 of the valve housing 43 between the inlet valve 39 and the outlet valve 41 communicates with the pump chamber 29. The tube 45 has a further annular groove 55 receiving a seal 56. All valve housings 43 are simultaneously enclosed in the pump housing 42 by means of a lid 100 with the interposition of a layer of elastic material 101. In order to avoid penetration of soil into the valve housing 43, particularly when the valve housing 43 as a unit is still located outside the pump housing 42, the fuel inlet 27 as well as each fuel outlet is provided with a filter. For example, a cylindrical filter 102 of filter gauze is arranged in the recess 51 and a filter 103 of filter gauze is enclosed in the fuel outlet 104 with the aid of a valve stop 105, which limits the maximum height of elevation of the outlet valve 41 and which is formed by a sleeve having radial recesses 106. The inlet valve 39 and the outlet valve 41 comprise each a valve body 78 of a synthetic resin and a copper supporting ring 57 for a valve spring 58.

Into each pump housing 42 is pressed a hard steel cylinder 59 with close forced fit. The pump housings 42 are pairwise arranged coaxially opposite one another and spaced apart from one another by the front faces 60 of the cylinders 59 by means of connecting members by a distance t. These connecting members are formed by fitting pins 61 and tapped sleeves 62, rigidly connecting the pump housings 42 with the frame 3. The front faces 60 are accurately held in relatively parallel positions by means of the fitting pins 61. The tapped sleeves 62 constitute in addition the connecting nipples for the fuel supply conduits 107 and the fuel return conduits 108 leading to the tank 99 and a pressure control-valve 152 included therein and connected with a return outlet 109. The return outlet 109 communicates through a channel 110 of the pump chambers 29 with the fuel inlet 27. Thus the fuel circulates at a high rate through the device 1 so that the fuel is not excessively heated in the device 1. It is therefore possible to mount the device 1 at a fairly hot place, for example, directly on the combustion engine 31. In each of the two pump housings 42 a vent screw 98 common to two pump chambers 29 seals a vent channel 97, which opens out at the top of the pump housings 42 so that the emerging fuel is collected in a fuel leak collecting space 96. The vent channel 97 communicates with the pump chambers 29 through inclined channels 94. The vent screw 98 is covered by a screw 95.

The displacer bodies 22 are each made of a synthetic resin, preferably a superpolyamide and are each formed by a cup-shaped piston 63, a guide collar 64 engaging the pump chamber 29 and an axially extending, elastically deformable tie member 65, whose end 92 is secured with the interposition of glue 91 in a wide bore 93 of a guide member 90 of a hard steel coupling member 20. Owing to the clearance between the tie member 65 and the bore 93 the piston 63 with the guide collar 64 is displaceable in a radial direction with respect to the guide member 90. The device 1 comprises two cross-shaped coupling members 20 by which the displacer bodies 22 of each pair of fuel pumps 32 are coupled with one another. Each coupling member 20 is connected by means of an elastic coupling 66 with an armature 18. This elastic coupling 66 comprises an elastic ring 67, accommodated in the coupling member 20 and surrounding a pin 68 of the armature 18 and preferably made of a superpolyamide.

The displaced volume of each fuel pump 32 is determined by the stroke of the coupling member 20, which is adapted to reciprocate by means of a bell-shaped arm 79 between the wedges 26 and 33. In order to obtain an accurate adjustment of said stroke both the coupling member 20 and the wedges 26 and 33 are made of hard steel, whilst the wedges 26 and 33 accommodated each in a guide groove 89 in a pump housing 42 are in engagement with a pump housing 42 with the interposition of a supporting layer 88 of a synthetic resin, preferably Arnite. In order to avoid excessive wear of these parts the comparatively small overall bulk of the coupling member 20 and the two displacer bodies 22 connected with the former is separated from the comparatively large bulk of the armature 18 by using the elastic coupling 66. At each stroke the coupling member 20 butts against a comparatively hard stop, whilst the bulk of the armature 18 continues to move over a small distance and is arrested resiliently.

Two housing blocks 69 comprise each two joined pump housings 42, between which wedges 26 and 33 are arranged to serve as common control-means for each of the pumps 32. The distance t and the coupling members 20 are particularly small since the wedges 26 and 33 are held in guide grooves 89 of the pump housings 42 so that inaccuracies of the fuel displacements due to deformation of coupling members and/or to mounting defects are slight. A satisfactory seal of the piston 63 is obtained since the guide member 90 guided in the cylinder 59 absorbs the tilting forces produced by the arm 79 forming a stop member striking a wedge 26 or 33 beyond the axial line 85 of the cylinder 59. In order to ensure a long lifetime of the device 1 each guide member 90 is coated with a wear-resistant material 87, preferably Rilsan, which is applied by dipping and subsequently machined to the prescribed size.

In the unmounted state illustrated in FIG. 10 the sealing rim 86 of the piston 63 projects radially beyond the guide collar 64. The sealing rim 86 is sharp so that in the mounted state it assumes the satisfactorily sealing form shown in FIG. 9 and has a long lifetime, particularly if the cylinder 59 is formed by a silver steel sleeve.

The armature 18 engages an adjustable setting member extending at right angles to the direction of movement of said armature 18 and being formed by a set screw 85. The armature 18 is adapted to pivot about the axial line 85 and is turned about said axial line 85 during the mounting operation so that the end 9 enters the slot 13 open at the top in the bearing element 11 and is received between the set screw 84 and a spring 111 in a recess 112, the armature 18 being subsequently urged against the set screw 84, which closes the slot 13. By means of the set screw 84 the amplitude of the armature 18 turning about the axial line 85 is adjusted and hence the spot of engagement of the ball-shaped arm 79 on the stop faces of the wedges 26 and 33 extending obliquely to the reciprocatory movement of the armature 18.

The wedge 26 is driven by a piston 80 of a control-cylinder 73 communicating downstream of an air inlet valve 113 with the air inlet manifold 72 of a combustion engine 31. The control-cylinder 73, the length of which is held at a minimum, is centered with respect to the frame 3 by means of a centering disc 114, which extends into the bore 115 of the control-cylinder 73 and in a centering hole 116 of the frame 3. The control-cylinder 73 is adapted to turn about the centering disc 114 and to be fixed in the desired position by clamping means formed by clamping screws 117 and clamps 119 engaging an external groove 118 of the control-cylinder 73. The top side of the control-cylinder 73 communicates through recesses 121 in the centering disc 114 and recesses 122 in the frame 3 with a fuel leak collecting space 96 so that any leakage can flow via the outer side of the piston 80 and the control-cylinder 73 towards the inlet manifold. In order to maintain the cleanness of the control-cylinder 73 a filter of filter gauze is arranged between the centering disc 114 and the frame 3. Externally of the control-cylinder 73, at the end remote from the wedge 26, an axially displaceable switch 82 is controlled by an extension 124 of the piston 80 for stopping the pumps 32 in the event of a drop beneath a given pressure in the inlet manifold 72. The switch 82 can be readily actuated.

A control-rod 126 extending axially across a wide bore 125 of the wedge 26 and being rigidly secured to the piston 80 is adapted to turn with respect to the wedge 26. Owing to the clearance between the bore 125 and the control-rod 126 and to the relative rotatability of the wedge 26 and of the control-rod 126 the high-frequency vigourous impacts of the armature 18 are hardly or not at all transferred to the piston 80.

The wedge 33 is adjustable in accordance with the engine speed. A screw rod 127 extending across the wedge 33 is adapted to turn with an amount of clearance and to be displaced in a transverse direction with respect to the wedge 33, which is urged by a spring 128 against a shoulder 129 of the screw rod 127. The top end of the screw rod 127 has a screwthread 130 engaging a screwthread piece 131 of a metal bellows barometer 133. After evacuation the bellows 133 is closed by a nipple 132. The top end of the bellows 133 supports a diaphragm 134 of a pressure chamber 135, which communicates through a choke 136 with the inlet manifold 72. The pressure chamber 135 has an air inlet 138 controlled by an air valve 137. The air valve 137 is closed by an electro-magnet 139, which is energized in accordance with the speed of the combustion engine 31. The electro-magnet 139 is each time energized upon the energization of an electro-magnet 2. If the speed of the combustion engine 31 is high, the air valve 137 remains closed so that a high vacuum is produced in the pressure chamber 135, as a result of which the quantity of fuel supplied is increased. Likewise the quantity of supplied fuel increases if the barometric air pressure is high. In both cases the wedge 33 is lifted.

The pressure chamber 135 comprises a control-member formed by the diaphragm 134, which is adjustably connected with the wedge 33, since the pressure chamber 135 together with the diaphragm 134 and the barometer bellows 133 is adapted to turn with respect to the screw rod 127. Since the head 140 of the screw rod 127 is prevented from turning in the guide groove 89, the starting position of the wedge 33 can be adjusted in an axial direction. After the adjustment the pressure chamber 135 is anchored by means of a safety pin 141 with respect to a holder 142.

Between the pump housings 42 and the hot electro-magnets 2 air gaps 144 are provided for heat insulation. These gaps 144 are covered by elastic strips 145 to prevent penetration of soil.

Each atomizer 30 has a needle 23, a conical end 21 of which is drawn by a strong spring 150 to the seat 149 so as to establish a seal. In the event of a high fuel pressure in a chamber 148 communicating with the fuel conduit 28 and through a perforated collar 147 with a chamber 151 said end 21 is lifted from the seat 149 against the action of the spring 150 (see FIG. 5).

Each electro-magnet 2 is controlled by a circuitry 170 shown schematically in FIG. 6. The transistors $TR_1$ and $TR_2$ together with the associated resistors $R_1$, $R_2$, $R_3$, $R_4$ and $R_5$ and with the capacitor C constitute a monostable multivibrator. The resistor $R_1$ and the capacitor C determine the time constant. The collector output of the transistor $TR_2$ constitutes via the resistor $R_4$ the input of the transistor $TR_3$, which serves as an amplifier for the current to be passed through the coil $L_1$ of the electro-magnet 2. Across the coil $L_1$ is connected a quench diode $D_1$. To the input terminals $K_1$ and $K_2$ is connected a current source 35, whereas the input $K_3$ serves for the supply of a control-pulse, which may originate from a pulse generator 34, which is coupled with the engine 31. The pulse generator 34 may be coupled with a cam shaft 163 of the combustion engine 31 and has a rotating contact 155, which alternately comes into contact with one of the four contacts 16 for the energization of the subcessive electro-magnets 2.

Each of these four contacts 16 is connected to an input terminal $K_3$ of the circuitry 170. In this way the fuel required for each combustion cylinder is injected during each cycle of the combustion engine 31 at the required instant by an atomizer 30. The order of energization of the electro-magnets 2 is chosen so that in each cycle each of the wedges 26 and 33 is briefly free of a coupling member 20 so that each of them can be displaced by a slight force. The switch 82 is connected between the contact 155 and the source 35 so that in disabling the switch 82 no control-pulses are given off. The electro-magnet 139 has also a circuitry 170, whose terminal $K_3$ is connected to each of the contacts 16.

In the variant shown in FIG. 11 the set screw 146 is disposed outside of the bearing element 11 on the bottom side of the armature 18, whereas the spring 111 is arranged on the top side.

What we claim:

1. A device for supplying fuel to at least one atomizer of a combustion engine, in which the pump chamber of at least one fuel pump, arranged in a pump housing has a displacer volume adjustable by control-means, communicates through an inlet valve with a fuel inlet and through an outlet valve with a fuel outlet to be connected with the atomizer of the combustion engine and is limited by at least one displacer body caused to reciprocate by driving means, said control-means comprising at least one wedge-shaped stop actuated by a control-member, said stop being coupled through a piston rod with the piston of a control-cylinder communicating with the inlet manifold of the combustion engine, characterized in that the control-cylinder is centered with respect to a frame holding the pump housing by means of a centering disc extending into the control-cylinder.

2. A device as claimed in claim 1 characterized in that the control-cylinder is adapted to turn about the centering disc and can be fastened to the frame by means of clamping members.

3. A device as claimed in claim 1 or 2 characterized in that the top side of the control-cylinder communicates through recesses in the centering disc and in the frame with a leaking fuel collecting space.

4. A device as claimed in claim 3 characterized in that a filter is arranged between the centering disc and the frame.

5. A device for supplying fuel to at least one atomizer of a combustion engine, in which the pump chamber of at least one fuel pump, arranged in a pump housing has a displacer volume adjustable by control-means, communicates through an inlet valve with a fuel inlet and through an outlet valve with a fuel outlet to be connected with the atomizer of the combustion engine and is limited by at least one displacer body caused to reciprocate by driving means, said control-means comprising at least one wedge-shaped stop actuated by a control-member, said stop being coupled through a piston-rod with the piston of a control-cylinder communicating with the inlet manifold of the combustion engine, characterized in that at the end of the control-cylinder remote from the stop an axially displaceable switch is provided for stopping the pump at a drop below a given pressure in the inlet manifold.

6. A device for supplying fuel to the atomizer of a combustion engine comprising at least one pump to be connected with the atomizer having a pump chamber limited by a piston and driving means for causing the piston to reciprocate, said driving means comprising an armature energized by at least one electro-magnet and adapted to reciprocate between stops characterized in that at least one of the stops is adjustable in accordance with the speed of the engine.

7. A device as claimed in claim 6 characterized in that the further stop is acted upon by a pressure chamber communicating through a choke with the inlet manifold of the combustion engine and having an air inlet controlled by an air valve, said air valve being electro-magnetically closed by an electro-magnet energized in accordance with the speed of the combustion engine.

8. A device as claimed in claim 6 or 7 characterized in that the adjustable stop is furthermore subjected to the action of a barometer.

9. A device as claimed in claim 7 or 8 characterized in that the adjustable stop has a screw rod which is adjustably connected with the control-member of the pressure chamber.

* * * * *